US007493749B2

(12) United States Patent
Stalder et al.

(10) Patent No.: US 7,493,749 B2
(45) Date of Patent: Feb. 24, 2009

(54) SPINNING POSITION WITH FIBER GUIDANCE ELEMENT

(75) Inventors: Herbert Stalder, Kollbrunn (CH); Kurt Ziegler, Kirchheim-Nabern (DE); Peter Artzt, Reutlingen (DE); Heinz Müller, Metzingen (DE)

(73) Assignee: Maschinenfabrik Rieter AG, Winterthur (CH)

( * ) Notice: Subject to any disclaimer, the term of this patent is extended or adjusted under 35 U.S.C. 154(b) by 12 days.

(21) Appl. No.: 10/578,967

(22) PCT Filed: Jul. 6, 2004

(86) PCT No.: PCT/CH2004/000423

§ 371 (c)(1),
(2), (4) Date: Mar. 27, 2007

(87) PCT Pub. No.: WO2005/045105

PCT Pub. Date: May 19, 2005

(65) Prior Publication Data

US 2007/0266694 A1 Nov. 22, 2007

(30) Foreign Application Priority Data

Nov. 11, 2003 (CH) ..... 1941/03

(51) Int. Cl.
*D01H 4/02* (2006.01)

(52) U.S. Cl. ..... 57/350

(58) Field of Classification Search ..... 57/315, 57/350

See application file for complete search history.

(56) References Cited

U.S. PATENT DOCUMENTS

| | | | | |
|---|---|---|---|---|
| 5,927,062 | A | 7/1999 | Deno et al. | |
| 6,928,803 | B2 | 8/2005 | Stalder et al. | |
| 2004/0025488 | A1 * | 2/2004 | Anderegg et al. | 57/400 |
| 2005/0204720 | A1 * | 9/2005 | Stahlecker | 57/350 |

* cited by examiner

*Primary Examiner*—Shaun R Hurley
(74) *Attorney, Agent, or Firm*—Dority & Manning, P.A.

(57) ABSTRACT

A spinning position for spinning yard from a fiber structure including a fiber guidance element is disclosed. The fiber guidance element includes a fiber guiding surface having a deflection point located in the interior of the fiber guidance element. The input direction of a fiber structure into the fiber guidance element forms an angle of inclination α with the fiber guiding surface at the deflection point. The splaying of the outer fibers of the fiber structure is increased and the quality of the yarn is thereby increased. The jamming of the fiber elements lying parallel to the direction of introduction may also be avoided.

21 Claims, 3 Drawing Sheets

SPINNING POSITION WITH FIBER GUIDANCE ELEMENT

FIELD OF THE INVENTION

The invention relates to a spinning position with a fiber guidance element used in the field of air-jet spinners.

BACKGROUND OF THE INVENTION

Air-jet spinners have a multiplicity of spinning positions. At every spinning position, a yarn is spun from an fiber structure. The fiber structure is first attenuated by reducing the amount of fiber per unit of length by a process called drafting. The attenuated fiber structure is then spun into a yarn at the spinning position by imparting twist. A spinning position includes a fiber guidance element with a fiber guiding surface. The fiber guidance element guides the fiber structure into a swirl chamber, where a yarn is produced in a spindle by the known vortex air-spinning process.

In FIG. 1 there is shown a fiber guidance element designed as a sleeve 3 with a fiber guiding surface 5 arranged inside. A fiber structure 1 is guided through the sleeve 3 from the pair of delivery rollers 2 of the upstream drafting system. High drafting system speeds lead to strong air flows in the region of the nip line of the delivery rollers. These air flows may lead to the breaking of the fiber structure. Due to the very high speeds at which the fiber structure is introduced from the drafting system into the spindle, the aim is to optimally design the entry of the fiber structure into the fiber guidance element located upstream of the spindle.

European Patent Application Publication No. EP 2 335 050 A2 proposes a sleeve in which two mutually inclined fiber guiding surfaces are arranged to form a deflecting location inside the sleeve. The deflecting location, formed as an edge, has the effect of lifting off the fiber ends and thereby increasing the proportion of free fiber ends on the surface of the fiber structure. These free fiber ends are taken up by the vortex flow before the spindle. Increasing the proportion of free fibers also has the effect of increasing the proportion of wrapping fibers of the yarn. As a result, the quality of a yarn spun in this way is improved. Although the deflecting location taught by EP 2 335 050 A2 improves the quality of the yarn, it does nothing to contribute to improving the flow conditions where the fiber structure 1 enters the fiber guidance element 3. When the fiber structure 1 enters the fiber guidance element 3, there is in particular the risk that the fibers lying parallel to the direction of introduction 34 will become jammed at edges that are necessarily present.

It is an object of the present invention to provide a spinning position with a fiber guidance element and to provide a fiber guidance element in which the flow conditions at the transition from the drafting system to the fiber guidance element are improved to achieve better conditions for the spinning of the fiber structure.

SUMMARY OF THE INVENTION

Objects and advantages of the invention will be set forth in part in the following description, or may be obvious from the description, or may be learned through practice of the invention.

By way of example, one exemplary embodiment of the present disclosure provides a spinning position for producing a yarn from a fiber structure. The spinning position includes a fiber guidance sleeve defining an interior. The fiber guidance sleeve includes a fiber guiding surface having a deflection point located in the interior of the fiber guidance sleeve. The fiber structure is introduced into the fiber guidance element in an input direction. The input direction forms an angle of inclination in relation to the direction of the fiber guiding surface at the deflecting point. The deflecting point may be arranged anywhere in the interior of the fiber guidance sleeve including the edge of the fiber guidance sleeve. For example, the deflecting point may be arranged at the end face of the fiber guidance element or otherwise set back or suitably positioned inside the fiber guidance element. This arrangement produces significantly improved flow conditions. In particular, a rolling or rocking motion of the fiber structure can be effectively inhibited.

BRIEF DESCRIPTION OF THE DRAWINGS

A full and enabling disclosure of the present subject matter, including the best mode thereof, directed to one of ordinary skill in the art, is set forth in the specification, which makes reference to the appended figures, in which.

DETAILED DESCRIPTION OF THE DRAWINGS

Figure 1:
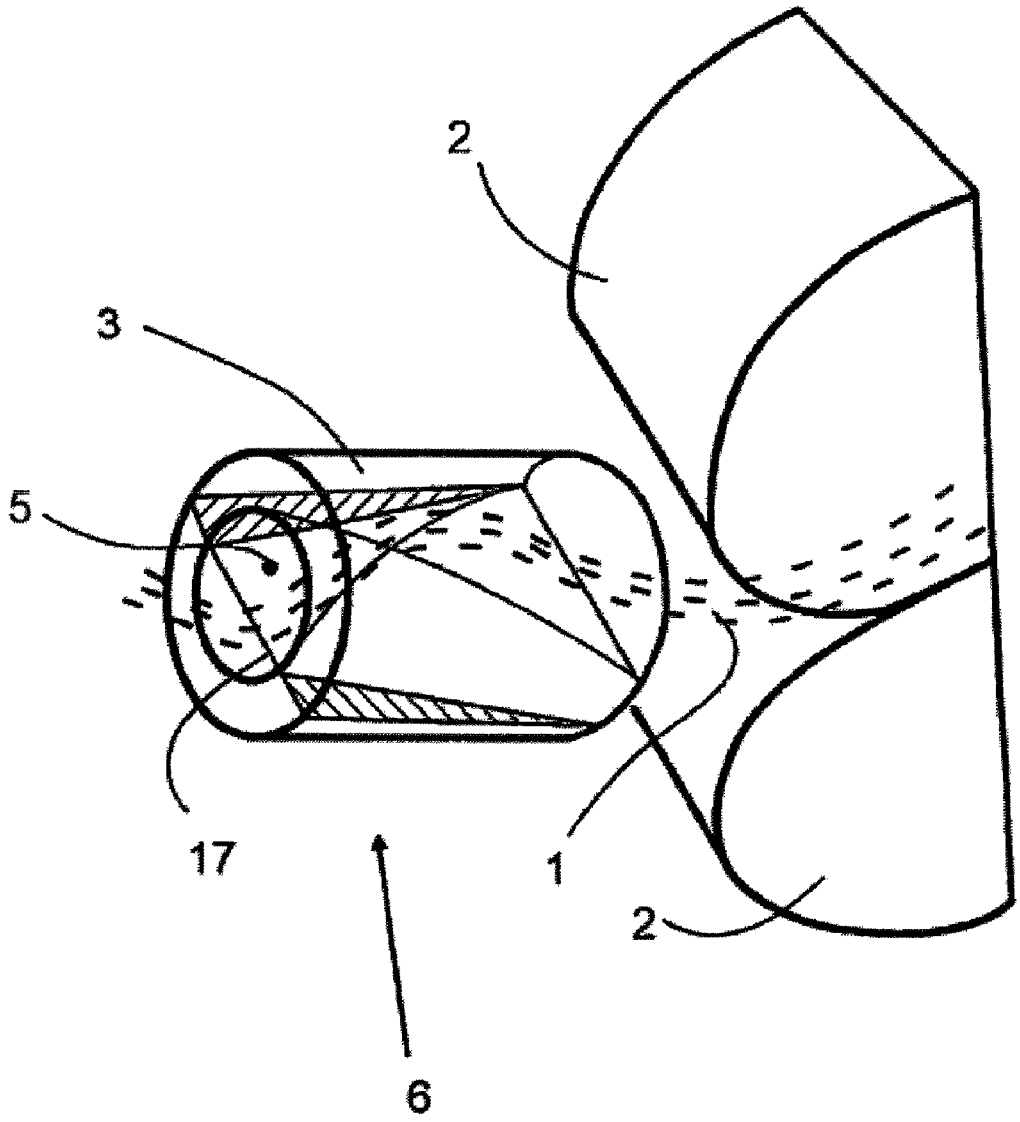
FIG. 1 shows a representation of a fiber guidance element and a pair of delivery rollers of a spinning position according to European Patent Application Publication Nos. EP 0 854 214 A2 and EP 1 335 050 A2.

Reference is now made to embodiments of the invention, one or more examples of which are illustrated in the drawings. Each embodiment is provided by way of explanation of the invention, and is not meant as a limitation of the invention. For example, features illustrated or described as part of one embodiment may be used with another embodiment to yield still a further embodiment.

Figure 2:
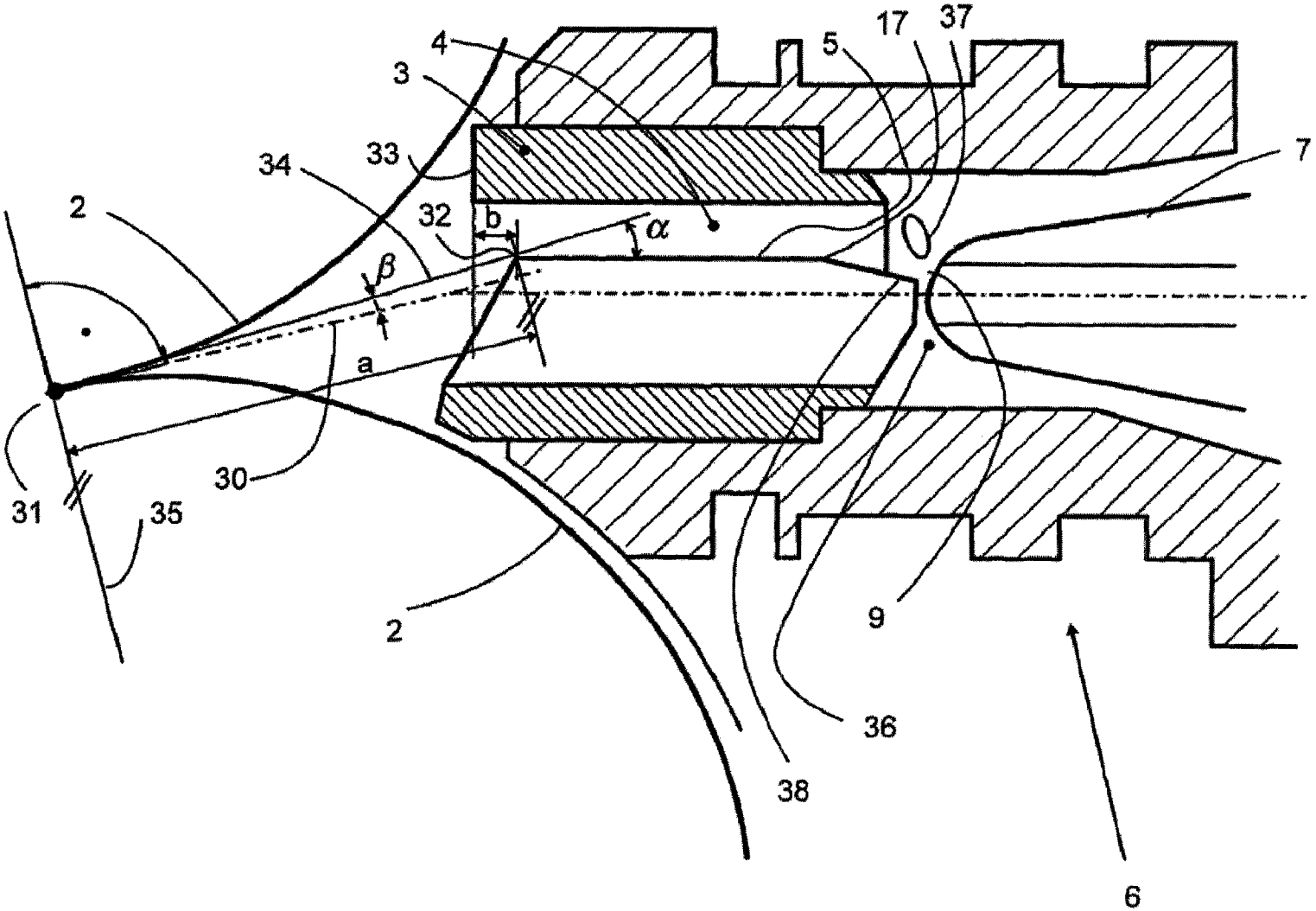
FIG. 2 shows a sectional representation of the fiber guidance element according to the invention at a spinning position.
Figure 3:
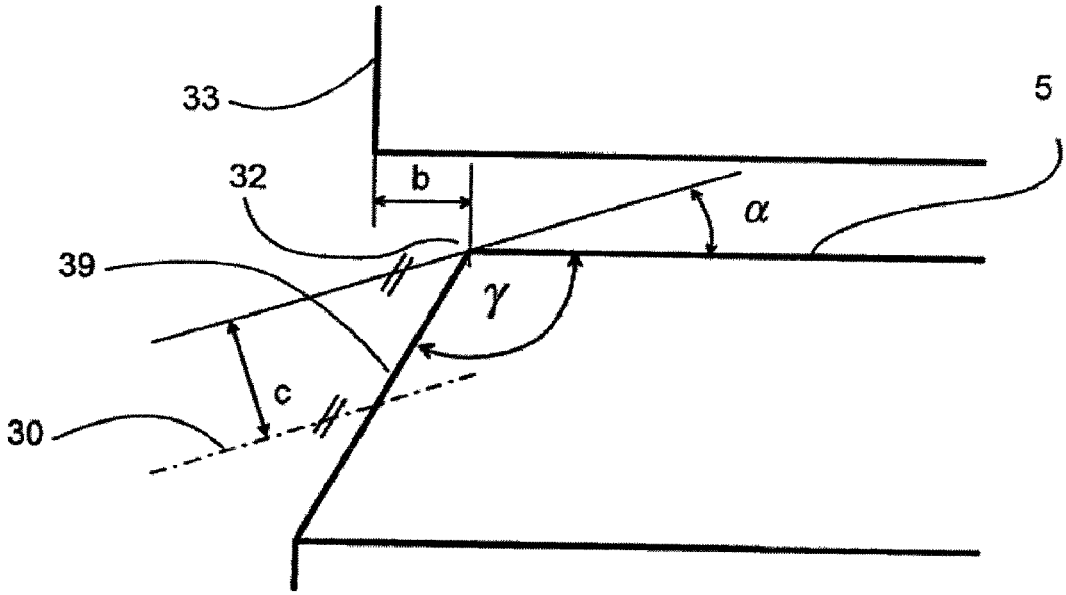
FIG. 3 shows a sectional representation that is less detailed than FIG. 2 of a fiber guidance element according to the invention.

Referring now to FIG. 1, the stated problem and the solution provided by the present disclosure is shown. FIG. 1 depicts a spinning position 6 of an air-jet spinner with a pair of delivery rollers 2 and a fiber guidance element 3 formed as a sleeve. As used herein, the terms fiber guidance element 3 and sleeve 3 are used synonymously. A fiber structure 1 is guided through the fiber guidance element 3 from the pair of delivery rollers 2 of the upstream drafting system. The upstream drafting system includes a pair of deliver rollers 2. The delivery rollers 2 have axes of rotation. These axes of rotation define a plane 35 as shown in FIG. 2 and FIG. 3. The drafting system also defines plane 30 as shown in FIG. 2 and FIG. 3. After passing through the fiber guidance element 3, the fiber structure 1 is subsequently spun into a yarn by imparting twist in the spindle 7. The task of the fiber guidance element 3 is to optimally introduce the fiber structure 1 to the subsequent swirl chamber 36 so that a yarn can be formed in the swirl chamber 36 by means of an air flow.

FIG. 2 shows a fiber guidance element 3 according to an exemplary embodiment of the present disclosure. The fiber structure 1 is transported in an input direction 34 into the fiber guidance element 3. A fiber guidance surface 5 is arranged in the interior of the fiber guidance element 3. To achieve a better splaying of the edge fibers, a deflection location is provided at the deflection point 32 located on the fiber guiding surface 34. The deflection point 32 is formed by an inclination between the direction of introduction 34 and the fiber guiding surface 5.

FIG. 2 also depicts an exit edge 17 used to achieve additional splaying of the edge fibers. A twist stop 38 is provided at the end of the exit edge 17. However, using the teachings disclosed herein, one skilled in the art will understand that the present invention is not limited to the particular design of the exit of the fiber guidance element. For example, the design of the exit of the fiber guidance element may be according to the teachings of European Patent Application Publication No. 1 335 050 A2. However, this configuration of the exit of the fiber guidance element is not prescribed as obligatory by the present invention. Upstream of the inlet mouth 9 in the swirl chamber 36 is an air entry opening 37.

Referring now to FIG. 3, the entry guidance element may also include a run-in ramp 39. The deflection point 32 may be formed by the run-in ramp 32 and the fiber guiding surface 5. It is particularly advantageous to arrange the deflection point 32 inside the fiber guidance element 3 with run-in ramp 39 so that the fiber structure 1 does not become jammed as it enters.

With reference to FIGS. 2 and 3 simultaneously, particularly advantageous dimensional specifications for the arrangement of the deflection point 32 are given below. It should be noted that, both together and on their own, these dimensional specifications make advantageous conditions possible for the entry of the fiber structure 1 into the fiber guidance sleeve 3:

i) The angle of inclination $\alpha$ between the fiber guiding surface 5 and the input direction 34 of the fiber structure 1 preferably lies in a range of values of $5° \leqq \alpha \leqq 85°$, with preference $5° \leqq \alpha \leqq 70°$, with particular preference $5° \leqq \alpha \leqq 25°$.

ii) The input direction 34 of the fiber structure is inclined with respect to the plane of the drafting system 30 by an angle $\beta$. The angle $\beta$ preferably lies in a range of values $0° < \beta \leqq 10°$.

iii) With reference to the plane 35, which is defined by the axes of the two delivery rollers 2, the entry edge 32 is at a distance a from said plane 35. The distance a preferably lies in a range of values of $9\ \text{mm} \leqq a \leqq 13\ \text{mm}$.

iv) The deflection point 32 is arranged with respect to the usually cylindrical shape of the sleeve 3 at the distance b from the upper end face 33 of the sleeve 3. The distance b preferably lies in a range of values of $0.01\ \text{mm} \leqq b \leqq 4\ \text{mm}$.

v) The deflection point 32 is at a distance c from the plane 30 of the drafting system. The distance c preferably lies in a range of values of $0\ \text{mm} \leqq c \leqq 3\ \text{mm}$.

vi) The run-in ramp 39 is inclined with respect to the fiber guiding surface 5 by an angle $\gamma$. The range of values preferably lies in a range of values of $100° \leqq \gamma \leqq 150°$.

As explained above, the values specified can be used both individually for the spinning position 6 or for the fiber guidance element 3 or in combination. Using the teachings disclosed herein, one of ordinary skill in the art will understand that the particular structural design of the fiber guidance element 3 is left open by the invention. For example a rounding may be performed at the deflection point 32.

LIST OF THE REFERENCE NUMERALS AND ABBREVIATIONS USED

1 fiber structure
2 pair of delivery rollers
3 fiber guidance element
4 fiber guiding channel
5 fiber guiding surface
6 spinning position
7 spindle
9 inlet mouth
17 exit edge at the fiber guiding surface of the fiber guidance element
30 plane of drafting system
31 nip line
32 deflection point at the fiber guiding surface 5 of the fiber guidance element 3
33 upper end face of the fiber guidance element 3
34 input direction of the fiber structure before entry into the fiber guidance element 3
35 plane formed by the axes of rotation of the delivery rollers 2
36 swirl chamber
37 air flow entry opening
38 twist stop
39 run-in ramp
$\alpha$ angle between fiber guiding surface 5 and input direction 34 of the fiber structure
$\beta$ angle between input direction of the fiber structure and plane 30 of drafting system
$\gamma$ angle between run-in ramp 39 and fiber guiding surface 5
a distance of entry edge 32 from plane defined by the axes of rotation of the delivery rollers 2 of the drafting system
b distance of entry edge 32 from upper end face 33 of the sleeve 3
c distance of entry edge 32 from plane of drafting system 30

The invention claimed is:

1. A spinning position for producing yarn from a fiber structure, comprising:

a fiber guidance sleeve defining an interior, said fiber guidance sleeve comprising a fiber guiding surface arranged in the interior of said fiber guidance sleeve, said fiber guiding surface having a deflection point, said deflection point located in said interior of said fiber guidance sleeve;

said fiber guidance sleeve configured to receive a fiber structure introduced into said fiber guidance sleeve at an input direction, said input direction forming an angle of inclination $\alpha$ between said input direction and said fiber guiding surface at said deflection point.

2. The spinning position of claim 1, wherein said angle of inclination $\alpha$ has a value in the range of about 5° to about 75°.

3. The spinning position of claim 1, wherein said angle of inclination $\alpha$ has a value in the range of about 5° to about 25°.

4. The spinning position of claim 1, wherein said angle of inclination $\alpha$ has a value of about 15°.

5. The spinning position of claim 1, wherein said fiber guidance sleeve further comprises an end face and said fiber guiding surface defines a direction; said deflection point being located at a distance b in the direction of said fiber guiding surface from said end face, said distance b having a value in the range of about 0.01 mm to about 4 mm.

6. The spinning position of claim 5, wherein the distance b has a value of about 1 mm.

7. The spinning position of claim 1, wherein the fiber guidance sleeve further comprises a run-in ramp, the run-in ramp being inclined by an angle $\gamma$ with said fiber guiding surface, the angle $\gamma$ having a value in the range of about 100° to about 150°.

8. The spinning position of claim 7, wherein the angle $\gamma$ has a value of about 120°.

9. The spinning position of claim 1, further comprising a drafting system located upstream of said fiber guidance sleeve, said drafting system defining a plane, said deflection point being located outside said plane defined by said drafting system.

10. The spinning position of claim 9, wherein the plane of the drafting system is inclined in relation to said input direction of said fiber structure by an angle $\beta$, said angle $\beta$ having a value in the range of about 0° to about 10°.

11. The spinning position of claim 10, wherein the angle β has a value of about 5°.

12. The spinning position of claim 9, wherein the drafting system comprises two delivery rollers having axes of rotation, said axes of rotation defining a plane, said deflection point being located at a distance a from said plane defined by the axes of rotation of said delivery rollers, said distance a having a value in the range of about 9 mm to about 13 mm.

13. The spinning position of claim 12, wherein the distance a has a value of about 11 mm.

14. The spinning position of claim 9, wherein the deflection point is located at a distance c from said plane defined by said drafting system, said distance c having a value in the range of about 0 mm to about 7 mm.

15. The spinning position of claim 14, wherein the distance c has a value of about 1 mm.

16. A fiber guidance sleeve for a spinning position of an air-jet spinner, the fiber guidance sleeve defining an interior, the fiber guidance sleeve comprising:

a fiber guiding surface arranged in the interior of said fiber guidance sleeve;

a run-in ramp; and a deflection point formed by said fiber guiding surface and said run-in ramp located in the interior of said fiber guidance sleeve.

17. The fiber guidance element of claim 14, wherein said fiber guidance sleeve further comprises an end face and said fiber guiding surface defines a direction; said deflection point being located at a distance b in the direction of said fiber guiding surface from said end face, said distance b having a value in the range of about 0.01 mm to about 4 mm.

18. The spinning position of claim 15, wherein the distance b has a value of about 1 mm.

19. The fiber guidance element of claim 14, wherein said run-in ramp is inclined by an angle γ with the fiber guiding surface, the angle γ having a value in the range of about 100° to about 150°.

20. The fiber guidance element of claim 14, wherein the angle γ has a value of about 120°.

21. A spinning position for producing yarn from a fiber structure, comprising:

a fiber guidance sleeve defining an interior; said fiber guidance sleeve comprising a fiber guiding surface defining a direction, said fiber guiding surface arranged in the interior of said fiber guidance sleeve, said fiber guiding surface having a deflection point, said deflection point being located in said interior of said fiber guidance sleeve, said fiber guidance sleeve configured to receive a fiber structure introduced into said fiber guidance sleeve at an input direction, said input direction forming an angle of inclination α between said input direction and said fiber guiding surface at said deflection point, said angle of inclination α having a value in the range of about 5° to about 75°;

an end face located at a distance b in the direction of said fiber guiding surface from said deflection point, said distance b having a value in the range of about 0.01 mm to about 4 mm;

a run-in ramp, the run-in ramp being inclined by an angle γ with said fiber guiding surface, the angle γ having a value in the range of about 100° to about 150°; and a drafting system located upstream of said fiber guidance sleeve, said drafting system defining a plane, the plane defined by said drafting system being inclined in relation to said input direction of said fiber structure by an angle β, said angle β having a value in the range of about 0° to about 10°, said deflection point being located at a distance c from said plane defined by said drafting system, said distance c having a value in the range of about 0 mm to about 7 mm;

the drafting system comprising two delivery rollers having axes of rotation, said axes of rotation defining a plane, said deflection point being located at a distance a from said plane defined by the axes of rotation of said delivery rollers, said distance a having a value in the range of about 9 mm to about 13 mm.

* * * * *